US009297332B2

(12) United States Patent
Knob et al.

(10) Patent No.: US 9,297,332 B2
(45) Date of Patent: Mar. 29, 2016

(54) CYLINDER HEAD WITH ANNULAR VALVE FOR INTERNAL-COMBUSTION ENGINE

(75) Inventors: Vaclav Knob, Praha (CZ); Ondrej Bolehovsky, Pisek (CZ)

(73) Assignees: KNOB ENGINES S.R.O., Prague (CZ); CZECH TECHNICAL UNIVERSITY IN PRAGUE, Prague (CZ)

( * ) Notice: Subject to any disclaimer, the term of this patent is extended or adjusted under 35 U.S.C. 154(b) by 117 days.

(21) Appl. No.: 14/115,247

(22) PCT Filed: May 3, 2012

(86) PCT No.: PCT/CZ2012/000037

§ 371 (c)(1),
(2), (4) Date: Dec. 5, 2013

(87) PCT Pub. No.: WO2012/149915

PCT Pub. Date: Nov. 8, 2012

(65) Prior Publication Data

US 2014/0083389 A1 Mar. 27, 2014

(30) Foreign Application Priority Data

May 3, 2011 (CZ) ..... 2011-259

(51) Int. Cl.

| | |
|---|---|
| ***F01L 1/28*** | (2006.01) |
| ***F02F 1/24*** | (2006.01) |
| ***F01L 3/20*** | (2006.01) |
| ***F01L 3/22*** | (2006.01) |
| *F01L 1/38* | (2006.01) |

(52) U.S. Cl.
CPC ... *F02F 1/24* (2013.01); *F01L 1/28* (2013.01); *F01L 3/20* (2013.01); *F01L 3/22* (2013.01); *F01L 1/38* (2013.01)

(58) Field of Classification Search
CPC ..... F01L 3/20; F01L 1/28; F01L 1/285; F01L 1/38; F01L 3/22; F02F 1/24; F02F 2001/244
USPC ..... 123/193.3, 79 R, 79 C, 188.2
See application file for complete search history.

(56) References Cited

U.S. PATENT DOCUMENTS

| | | | | | |
|---|---|---|---|---|---|
| 2,222,730 | A | * | 11/1940 | Wallgren | 123/188.6 |
| 4,503,817 | A | * | 3/1985 | Klomp et al. | 123/79 R |
| 5,555,859 | A | * | 9/1996 | Melchior et al. | 123/79 C |
| 5,673,656 | A | * | 10/1997 | Knob | 123/79 R |
| 5,782,215 | A | * | 7/1998 | Engelmann | 123/79 C |
| 5,803,042 | A | * | 9/1998 | Bortone | 123/312 |
| 2004/0031454 | A1 | * | 2/2004 | Hirano | 123/79 C |

* cited by examiner

*Primary Examiner* — Marguerite McMahon
(74) *Attorney, Agent, or Firm* — Andrew Wilford

(57) ABSTRACT

A cylinder head for an internal combustion engine has a body, a rigid center spacedly surrounded by the body, an annular outer valve seat on the body, and an annular inner valve seat on the center. A ring-shaped valve has an outer seat face and an inner seat face and is displaceable along an axis into a closed position bearing on the outer valve seat with the outer seat face and on the inner valve seat with the inner seat face. The inner valve seat or outer valve seat is slidable axially. A seal member set in a groove in the center or in the body engages the one slidable seat. At least one biasing member connected to the one slidable valve seat urges same toward the ring-shaped valve.

8 Claims, 10 Drawing Sheets

CYLINDER HEAD WITH ANNULAR VALVE FOR INTERNAL-COMBUSTION ENGINE

FIELD OF THE INVENTION

This invention relates to a cylinder head of an internal-combustion engine equipped with a lift valve whose annular plate has sealing surfaces on its inner and outer peripheries. The valve when closed position sits with these inner and outer seat surfaces onto inner and outer valve surfaces in the cylinder head.

BACKGROUND OF THE INVENTION

Many embodiments of a cylinder head with a ring-shaped valve or valves has been proposed. Most of them deal with the principle of cylinder charge exchange with a four-stroke or two-stroke cycle with use of the ring-shaped valve. They do not usually deal with construction details of valve sealing. In some cases the seal surfaces of the inner and outer valve seats are on one planar or conical surface in order to be able to easily precisely machine these surfaces in one operation and ensure sufficient tightness of the ring-shaped valve. These solutions are described e.g. in U.S. Pat. No. 2,222,730, U.S. Pat. No. 2,222,731, DE 3438847 A1, or U.S. Pat. No. 5,673,656. Tightness of the ring-shaped valve in both valve seats is however a problem not only from the point of view of precise machining of valve seats and valves, but even with respect to thermal and mechanical deformations. This could be deformations of the cylinder head, of both of the valve seats, and finally of the ring-shaped valve. A further problem for tightness of the ring-shaped valve is unequal wear of seat faces of the outer and inner seat and valve. The question is the design of seats and cylinder head with respect to their installation into the cylinder head, adjustment and repairs.

SUMMARY OF THE INVENTION

The above deficiencies are to a considerable extent removed in an internal-combustion engine with a ring-shaped valve comprising a body and a rigid center of the cylinder head and where the ring-shaped valve is formed with an outer seat face and an inner seat face and that in a closed position sits down into the outer valve seat with the outer seat face and into the inner valve seat with the inner seat face according to this solution. Its substance is that the inner valve seat and/or the outer valve seat is mounted so as to be axially slidable relative to at least one biasing member that applies a force against the ring-shaped valve.

The slidably movable inner valve seat and/or the outer is valve seat is provided with at least one seal member between the inner valve seat and the center of the combustion engine cylinder head and/or between the outer valve seat and the body of the combustion-engine cylinder head.

The seal member is set in a groove in the center of the cylinder head of the combustion engine and/or in the cylinder head body of the combustion engine. The seal member is formed by the seal ring on the slideably moveable inner valve seat the contact diameter of seal member with the inner valve seat being larger than the seat face diameter of this inner valve seat in engagement with the ring-shaped valve.

The seal member is formed by the seal ring on the slideably moveable outer valve seat, the contact diameter of seal ring with the outer valve seat being smaller than the seat face diameter of this outer valve seat in engagement with the ring-shaped valve.

The slidably movable inner valve seat and/or the outer valve seat is provided with a safety element preventing its pulling toward the cylinder. The slidably movable inner valve seat and/or the outer valve seat is provided with at least two stems extending through the center and/or through the body of the cylinder head of the combustion engine and provided with adjustable stops and/or dampers on their ends.

The seat face of the slidably movable inner valve seat and/or the outer valve seat is part-spherical.

The biasing member is formed by a hydraulic spring with a throttle in the oil supply and/or one-way throttle in the oil supply.

The center of the combustion engine cylinder head is demountable from the body of the combustion engine cylinder head and/or valve guide for guiding the valve stems of the ring-shaped valve fitted with radial clearance in the center and/or in the body of the combustion engine cylinder head.

The cylinder head of the combustion engine with the ring-shaped valve achieves flow parameters not achievable by any solution with classic lift valves. It is thus possible to use it in new modern internal-combustion engines. Thanks to the concentric circular shape of the valve seats and valve plate with the cylinder of the engine there is thermally uniform stress of all parts of the cylinder head. In this arrangement where the outer valve seat is fixed and the inner valve seat is axially movable the center of the cylinder head is less stressed than usual. Most of pressure force urges the valve into the outer valve seat. Thanks to lower stress and simple shape there is no danger of the cylinder head cracking even at high combustion pressure and temperature. The inner valve seat must have a certain axial overlap T in order to ensure valve tightness. The size of this overlap is given by the stop position of seat movement toward the cylinder defined by e.g. the safety ring. During installation is possible to set the desired lift of the movable seat needed for safety and durable sealing of the ring-shaped valve in the closed position. Wear of seat face stops increase lift of slidably mounted seat. Wear of the seat face for valve by this slidably mounted seat decreases the adjusted overlap of the slidably mounted seat. Wear of the seat face between the second fixed seat and the valve increases overlap of the movable seat. It is advantageous that two wear factors increase the adjusted overlap and one factor decreases it. It follows that for sufficient sealing the overlap is permanent for a long period and will not need to be adjusted.

BRIEF DESCRIPTION OF THE DRAWINGS

The cylinder head of the combustion engine with a ring-shaped valve according to the invention will be described in more detail by individual examples shown on the attached drawings.

DETAILED DESCRIPTION OF THE PREFERRED EMBODIMENTS

Figure 1:
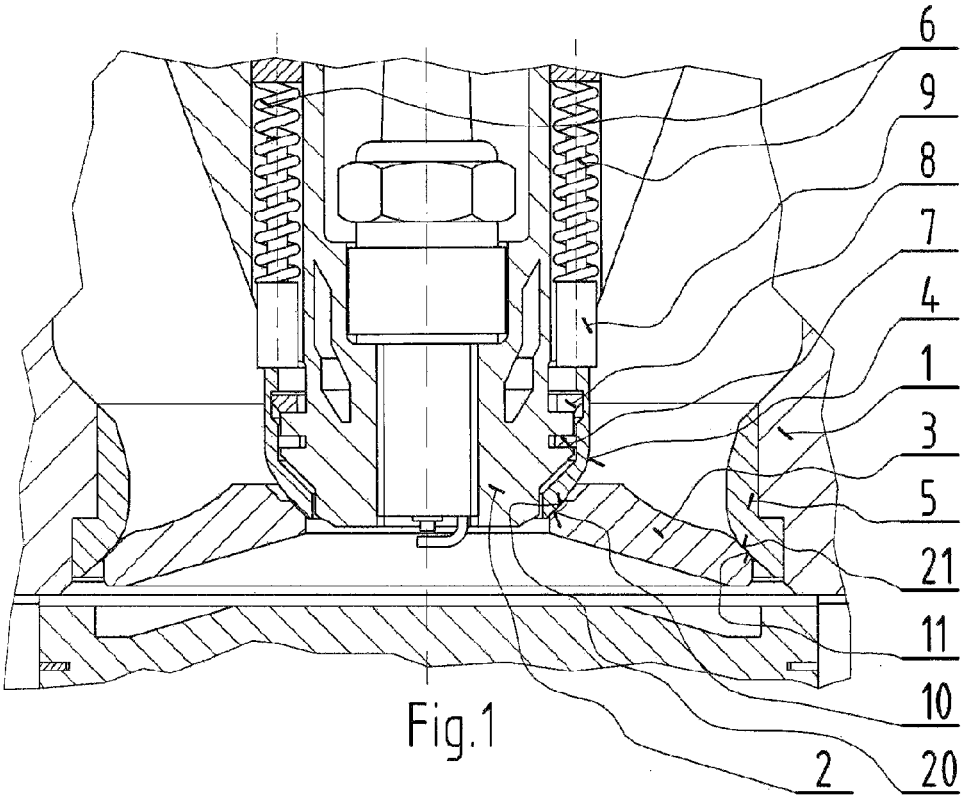
FIG. 1 is a sectional view of a cylinder head of the combustion engine with a ring-shaped valve and the inner and outer valve seats. The outer valve seat is fixed in the cylinder head of the combustion engine and the inner valve seat is mounted axially slidably. The inner valve seat is biased toward the ring-shaped valve by coil springs carried on support pins and is sealed against the center of the combustion engine cylinder head by a seal ring and secured by a safety ring. The face of the inner valve seat is part-spherical in shape.
Figure 2:
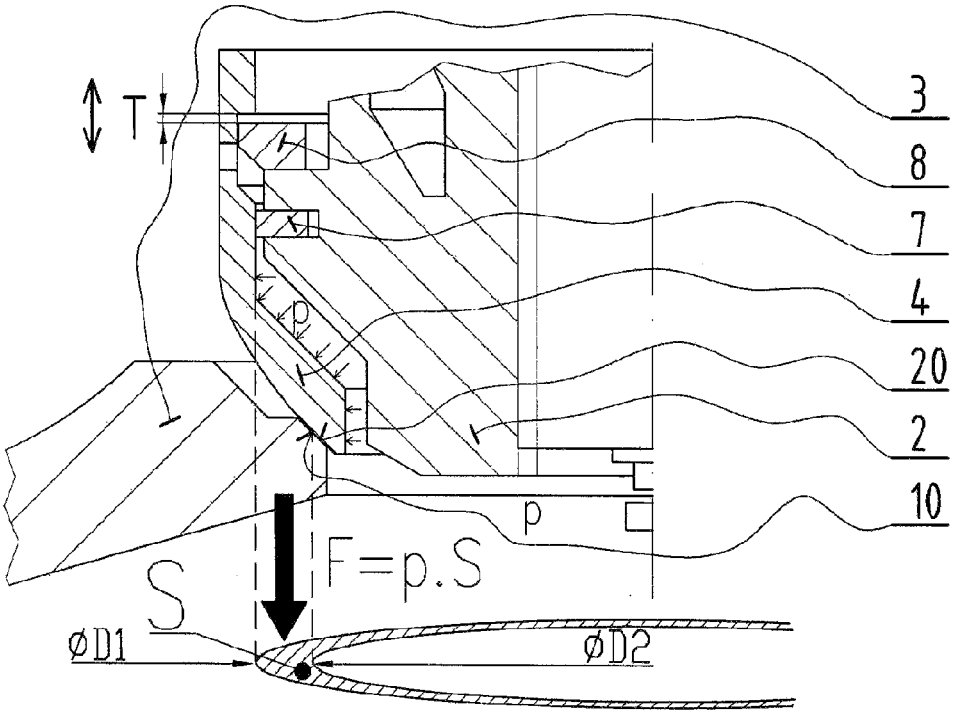
FIG. 2 is an enlarged sectional view of the inner valve seat from FIG. 1. The illustrated ring-shaped valve is in a closed position. The lift of the inner valve seat is shown at T. A projection of surface S, on which acts a pressure p and a product of these factors as a pressure force F pushing the inner valve seat against the ring-shaped valve.
Figure 3:
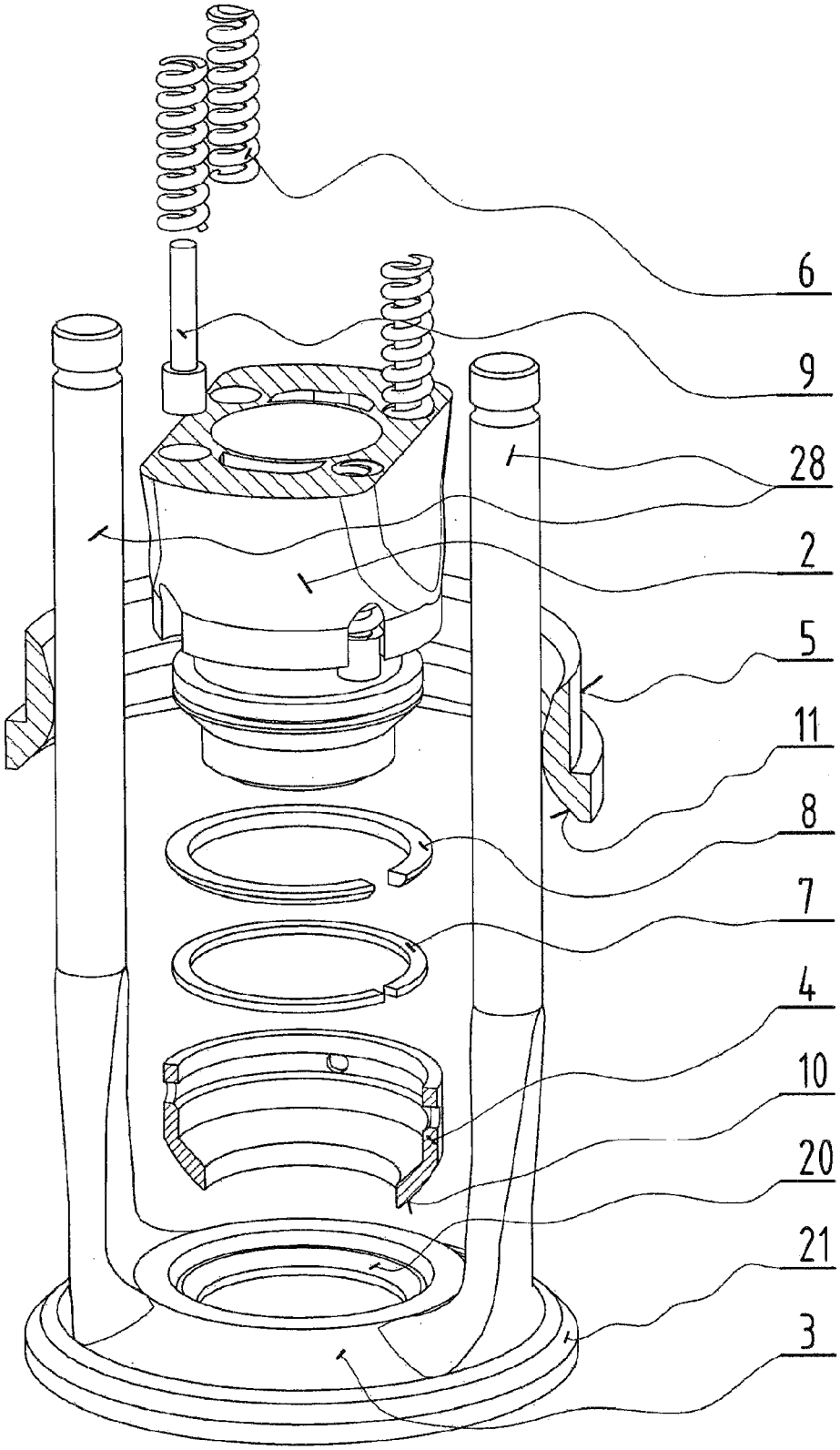
FIG. 3 is an axonometric view of the ring-shaped valve, both valve seats, the center of the cylinder head, the rings, the springs and the pins shown on FIG. 1.
Figure 4:
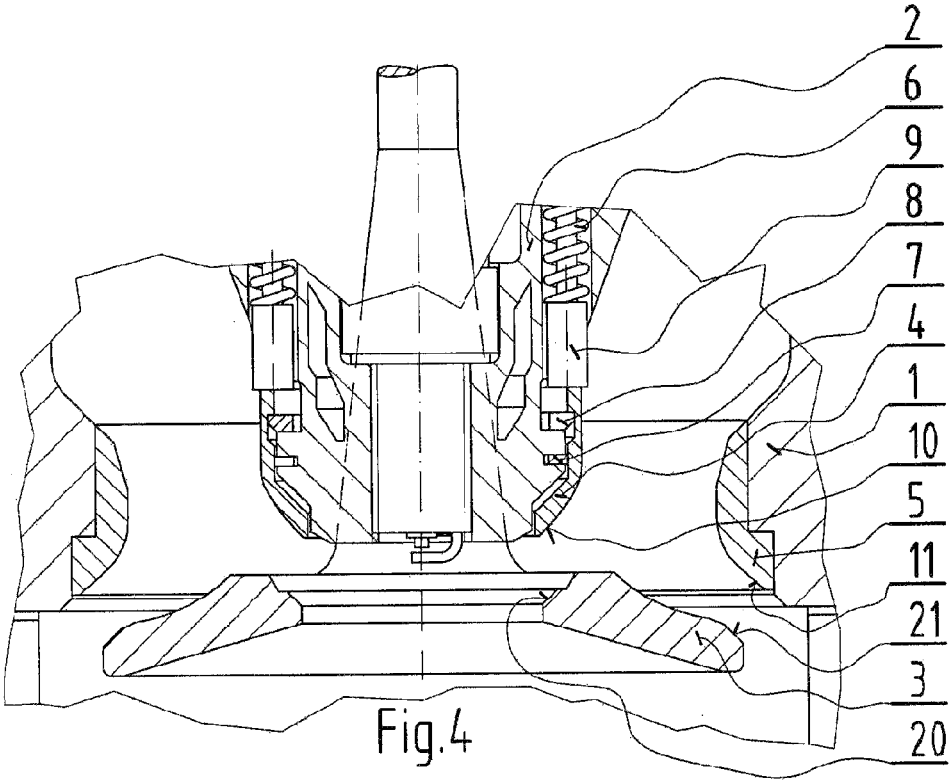
FIG. 4 is a sectional view of the cylinder head from FIG. 1, but here the ring-shaped valve is opened and the inner valve seat is slid toward the cylinder.

The model cylinder head of a combustion engine with the ring-shaped valve according to FIGS. 1 to 4 is formed by a body 1 and a rigid center 2 of the cylinder head. In the cylinder head is situated the ring-shaped left valve 3 with a frustoconical outer seat face 21 and a frustoconical inner seat face 20. This ring-shaped valve 3 when closed sits down into an outer valve seat 5 fixed in the body 1, and the inner valve seat 4, which is axially slidable in the center 2 of the cylinder head of the combustion engine. A seat face 11 of the outer valve seat 5 is frustoconical and the seat face 10 of the inner valve seat 4 is part-spherical. Pins 9 bear downward on the inner valve seat 4 with spring biasing elements 6. The inner valve seat 4 is sealed by a seal ring 7 fitted in a groove in the rigid center 2 and secured by a safety member 8, in this case by a ring.

Figure 5:
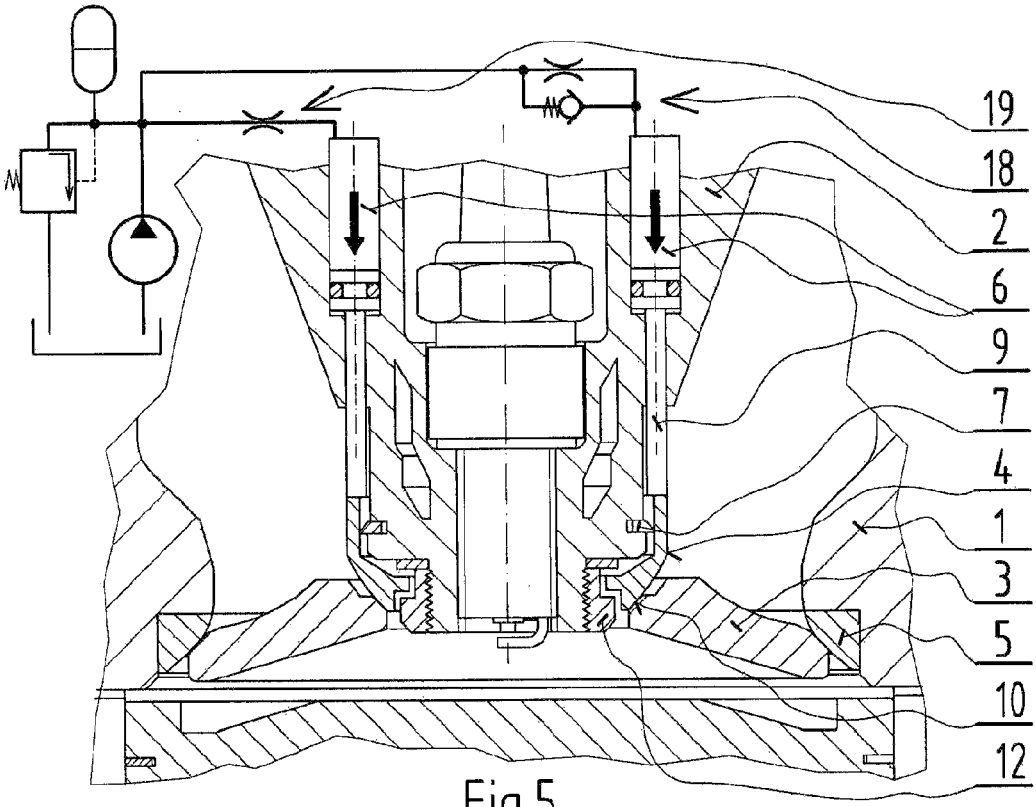
FIG. 5 is a sectional view of the cylinder head with the ring-shaped valve like FIG. 1. But the inner valve seat is secured by a thrust nut instead of the safety ring. The seal ring is provided with a chamfer for improving the tightness and hydraulic cylinders with damped movement function as a biasing member.

The cylinder head of an internal-combustion engine with the ring-shaped valve 3 according to FIG. 5 is based on the embodiment according to FIG. 1. Here the biasing member 6 is a hydraulic spring 19 with damping by a throttle 19 or by a one-way valve 18 in an oil supply. Lift of the axially slidable seat 4 is limited by the safety member in the shape of a thrust nut 12 mounted on the center 2 of the cylinder head. Sealing is effected is by a seal member 7 in the shape of a ring with a chamfer.

Figure 6:
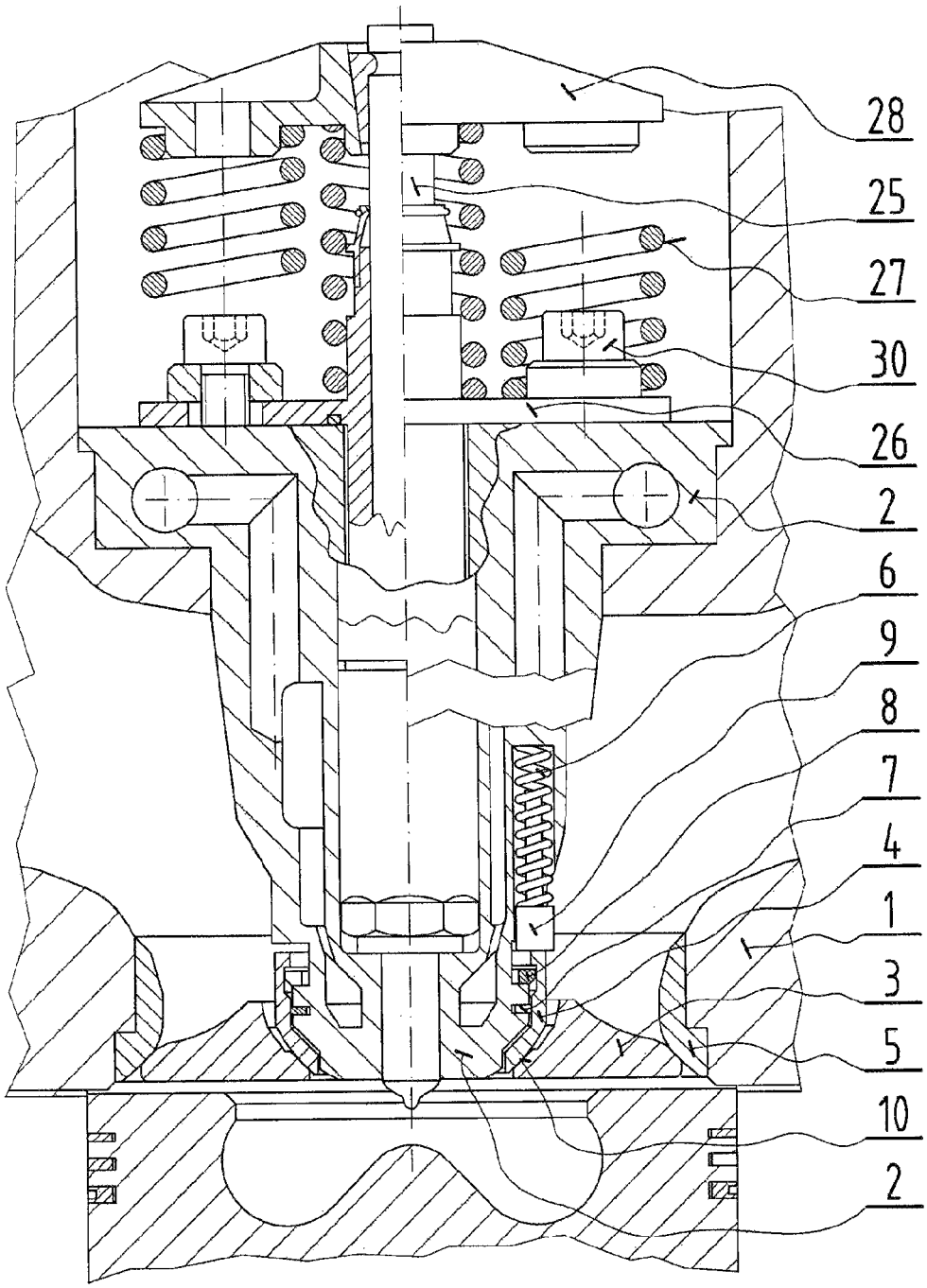
FIG. 6 is a sectional view of the cylinder head with the ring-shaped valve for a compression ignition engine. This figure shows a demountable center of the cylinder head with supply of coolant, valve guide, valve springs etc. The inner valve seat and its action is similar to FIG. 1.
Figure 7:
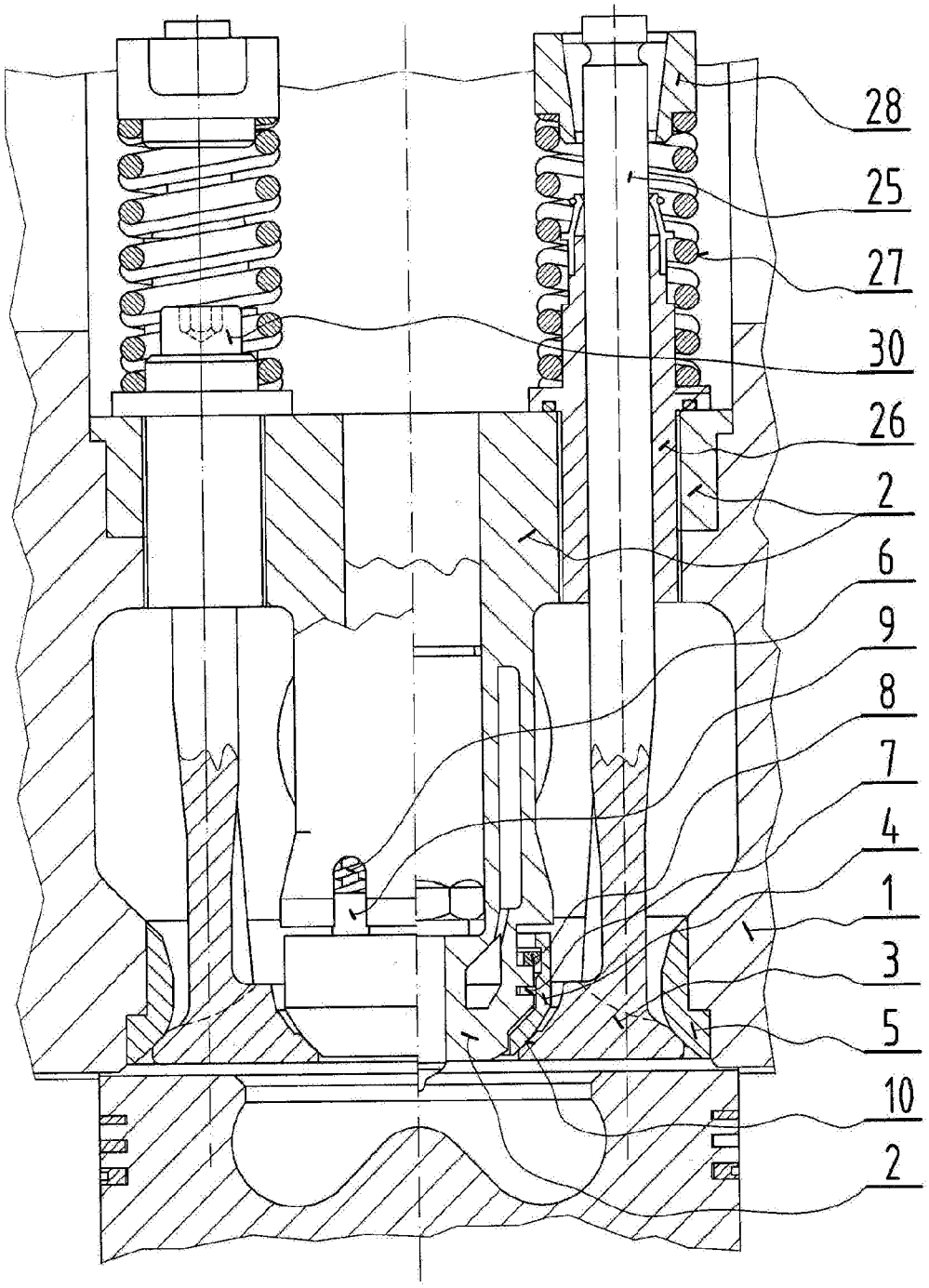
FIG. 7 is a cross-sectional view of the cylinder head of FIG. 6.

The cylinder head of an internal-combustion engine with the ring-shaped valve 3 according to FIG. 6 and FIG. 7 is based on the embodiment according to FIG. 1. The ring-shaped valve 3 has a flat shape suitable for a diesel engine. The rigid center 2 is demountable from the body 1 of the cylinder head. Two valve stems 25 of the ring-shaped valve 3 are guided in two guides 26 in the center 2 and the body 1 of the cylinder head mounted with radial clearance. They are fastened by bolts 30. Two valve springs 27 are seated on two clamps 28 fixed to the two stems 25 of the ring-shaped valve 3.

Figure 8:
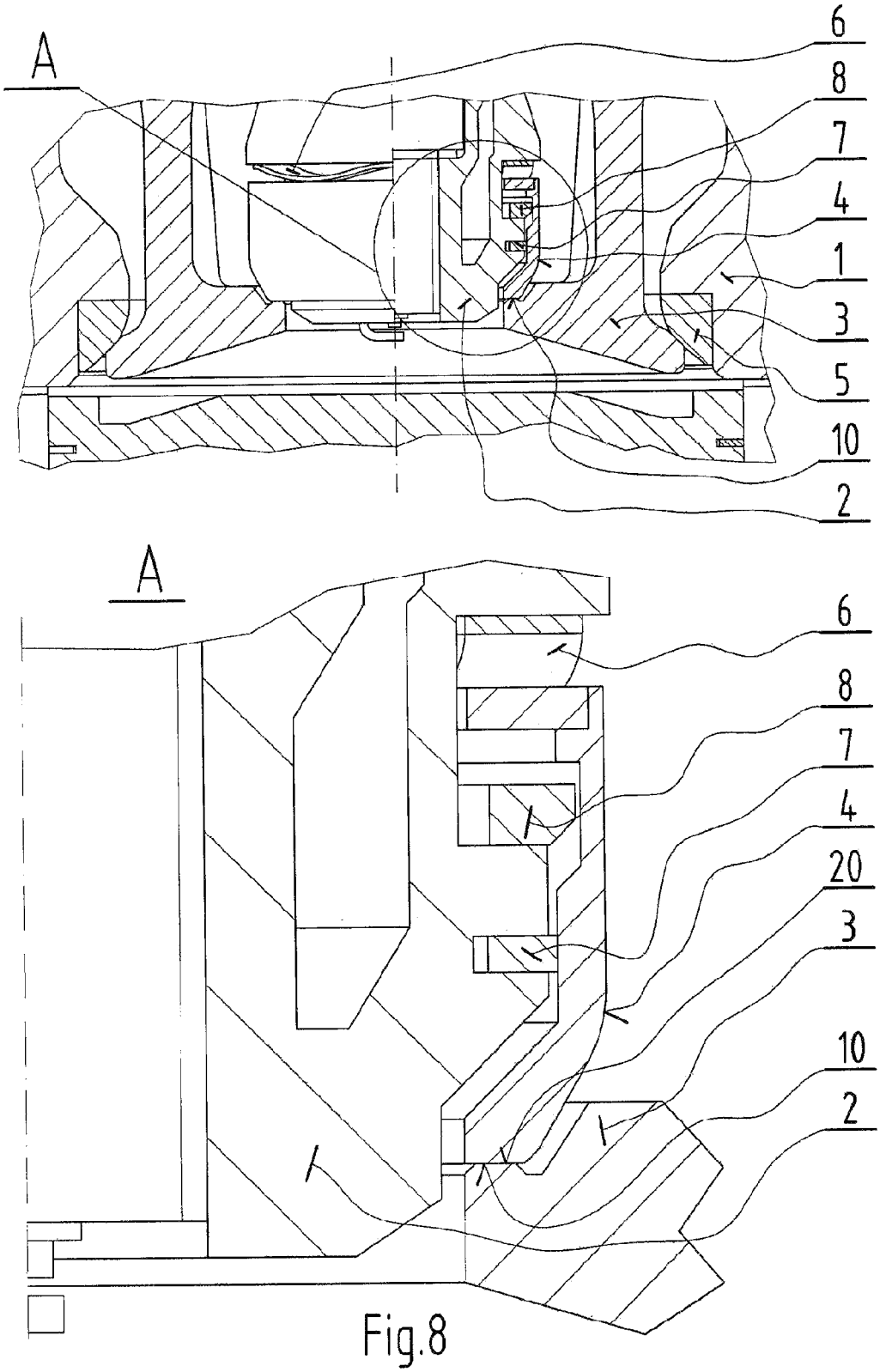
FIG. 8 is a sectional view and detailed sectional view of the cylinder head with a design similar to FIG. 1. The difference is in use of a spring made of corrugated iron instead of coil springs. The seat face of the valve seat is flat instead of part-spherical.

In the cylinder head of an internal-combustion engine with the ring-shaped valve 3 according to FIG. 8 the seat face 10 of the axially slidable inner valve seat 4 is of planar shape. Likewise, the seat face 20 on the ring-shaped valve 3 is planar in shape. Biasing of the inner valve seat 4 is performed by the spring-type biasing element 6 made of corrugated iron.

Figure 9:
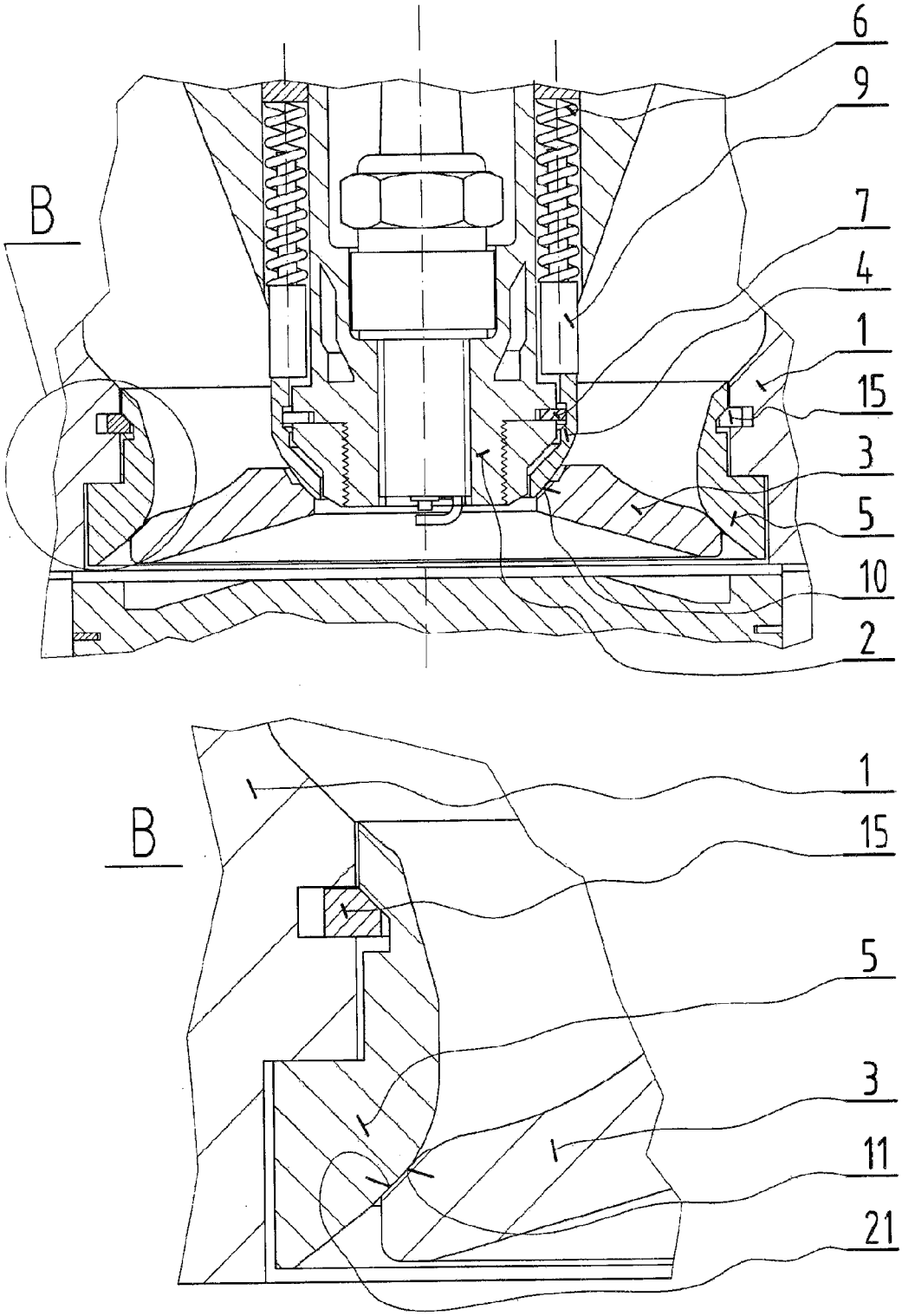
FIG. 9 is a sectional view and detailed sectional view of the cylinder head with a design similar to FIG. 1. The difference is in use of an outer valve seat mounted with small radial clearance and secured against movement by a safety ring with a chamfer. Another difference is that the safety ring of the axially movable inner valve seat is removed and his function has seal ring.

In the cylinder head of an internal-combustion engine with the ring-shaped valve 3 according to FIG. 9 the inner valve seat 4 is axially slidable. The ring-shaped seal member 7 axially fastens the inner valve seat 4, thereby preventing its pulling toward the cylinder. Another safety member is not used. The outer valve seat 5, which is not axially movable, is in the body 1 of the head fitted with small radial clearance. It is secured against axial movement and pulling out by a safety ring 15. Radial clearance of the outer valve seat 5 enables keeping ideal circularity of the seat face 11.

Figure 10:
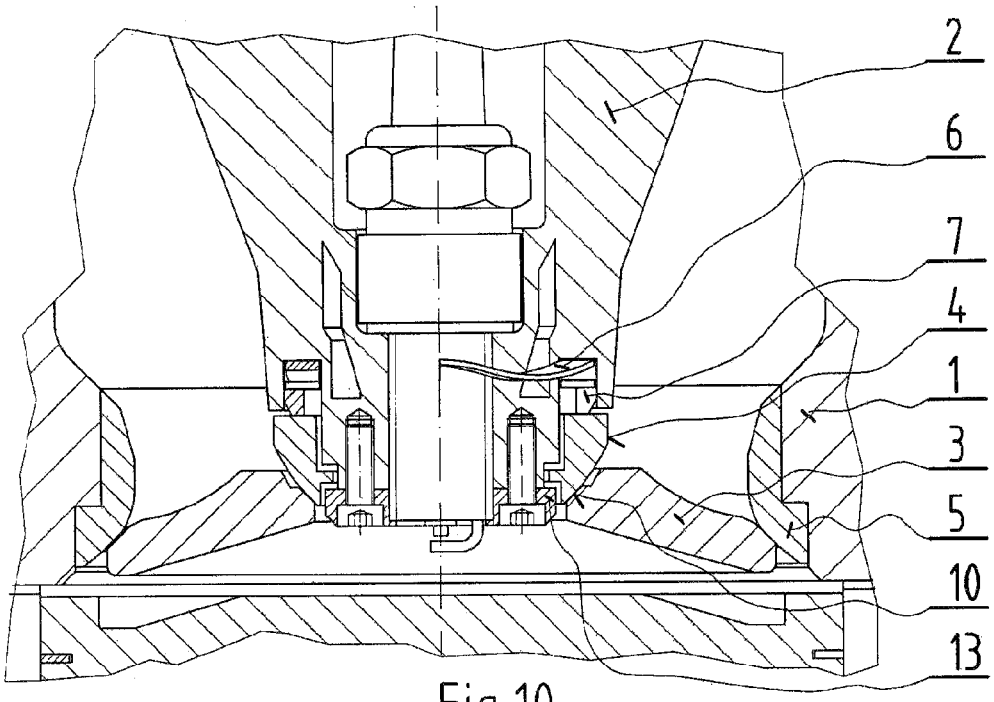
FIG. 10 is a sectional view of the cylinder head with the ring-shaped valve and the inner and outer valve seats. The outer valve seat is fixed in the cylinder head and the inner valve seat is mounted axially slidable. The inner valve seat is pushed against ring-shaped valve by spring made of corrugated iron. Between the spring and the valve seat is a seal ring bearing axially downward on the seat with its face. The stop limiting sliding of the seat is a circular plate fixed by bolts to the center of the cylinder head.

In the cylinder head of an internal-combustion engine with the ring-shaped valve 3 according to FIG. 10 the inner valve seat 4 is axially slidable. The seal ring 7 sits down frontally on it and fits in a frontal groove in the rigid center 2. On a second frontal surface of seal ring 7 sits a spring-biasing member 6 made of corrugated iron. Movement of axially slidable seat 4 is limited by the safety member, in this case by a plate 13 fixed on the rigid center 2 by bolts.

Figure 11:
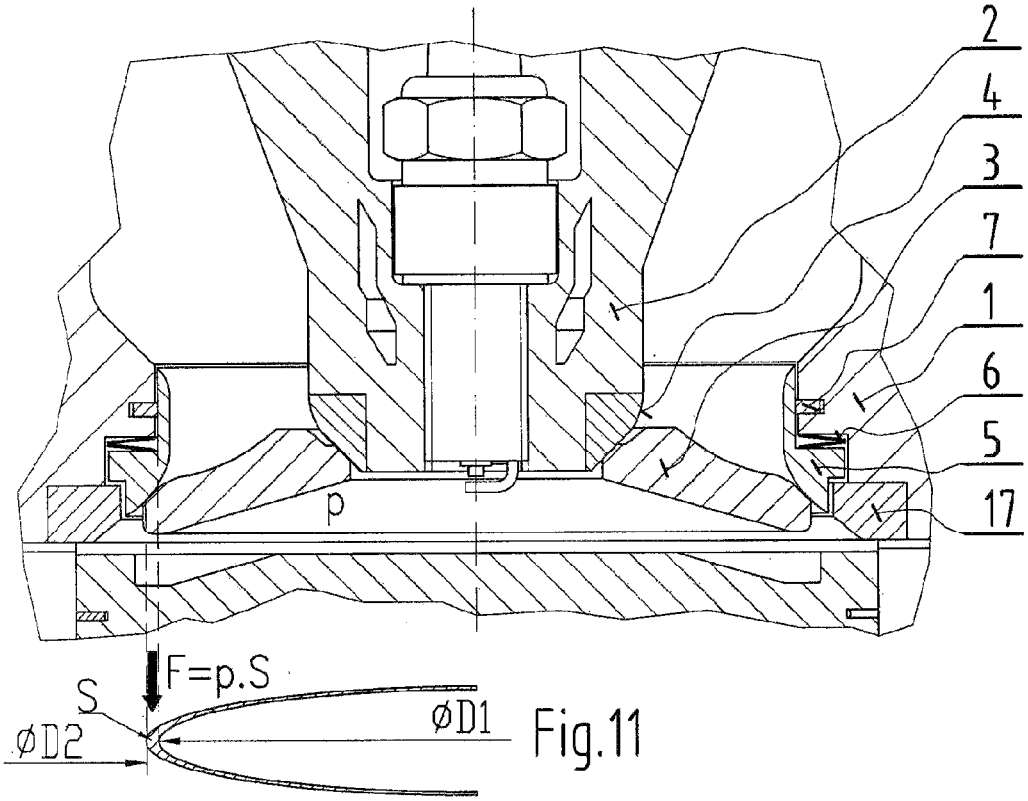
FIG. 11 is a sectional view of the cylinder head with the ring-shaped valve and the inner and outer valve seats. The outer valve seat is mounted axially slidably in the cylinder head and the inner valve seat is fixed on the center of the cylinder head. The outer valve seat is pushed against the ring-shaped valve by a plate spring and is sealed by a seal ring against the cylinder head. The stop limiting sliding out of the seat is formed by a circular ring.
Figure 12:
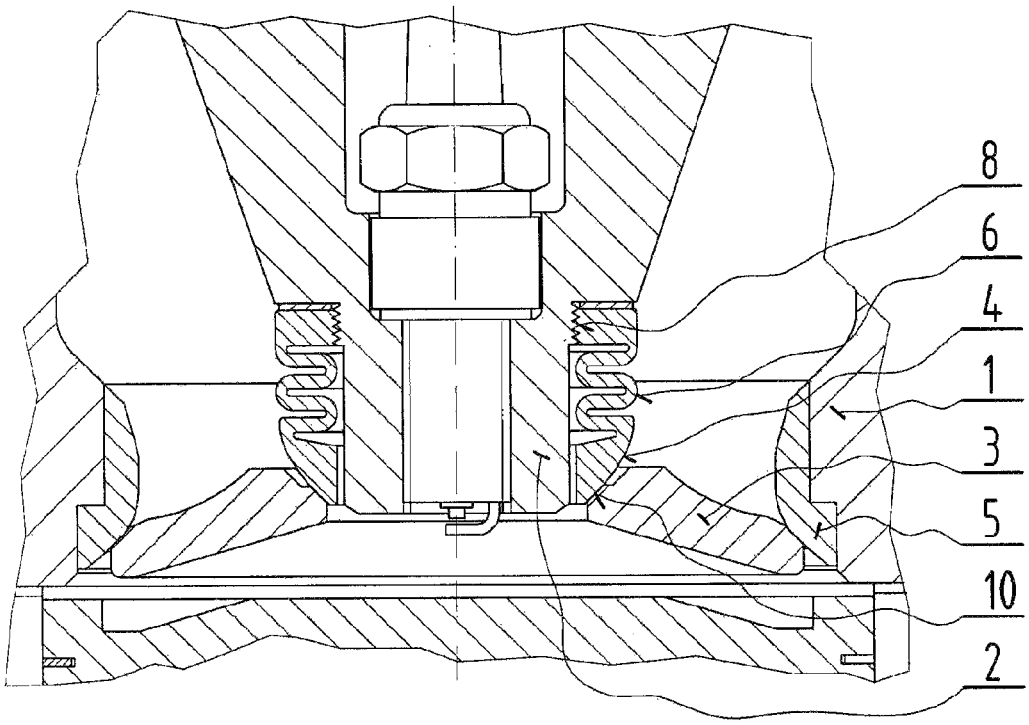
FIG. 12 is a sectional view of the cylinder head with the ring-shaped valve and the inner and outer valve seats. The inner valve seat is a bellows that functions as a spring. At the bottom of bellows is a seat face for the ring-shaped valve and at the top is a threaded connection preventing it from pulling out toward the cylinder.

In the cylinder head of an internal-combustion engine with the ring-shaped valve 3 according to FIG. 11 the axially slidably mounted outer valve seat 5 and the inner valve seat 4 are fixed in the center 2 of the head. A groove in the body 1 of a head holds the seal ring 7 that fits on the outer valve seat 5. Biasing of the outer valve seat 5 is performed by the biasing element 6 in the shape of a plate spring. Securing of the outer valve seat 5 is performed by an annular safety ring 17 mounted on the body 1.

In the embodiment of a cylinder head of an internal-combustion engine with the ring-shaped valve 3 according to FIG.

12 the axially slidable inner valve seat 4 is in the shape of a bellows. The middle part fulfils the function of the biasing member 6. At the bottom is seat face 10 and at the top is a bellows secured by the safety member 8 whose threaded connection prevents movement toward the cylinder. The advantage of this is the absence of the seal member 7. But there will be high demands on material of a bellows, which will be cyclically stressed by pressing by the valve 3, combustion pressures in a cylinder and changing of temperatures.

Figure 13:
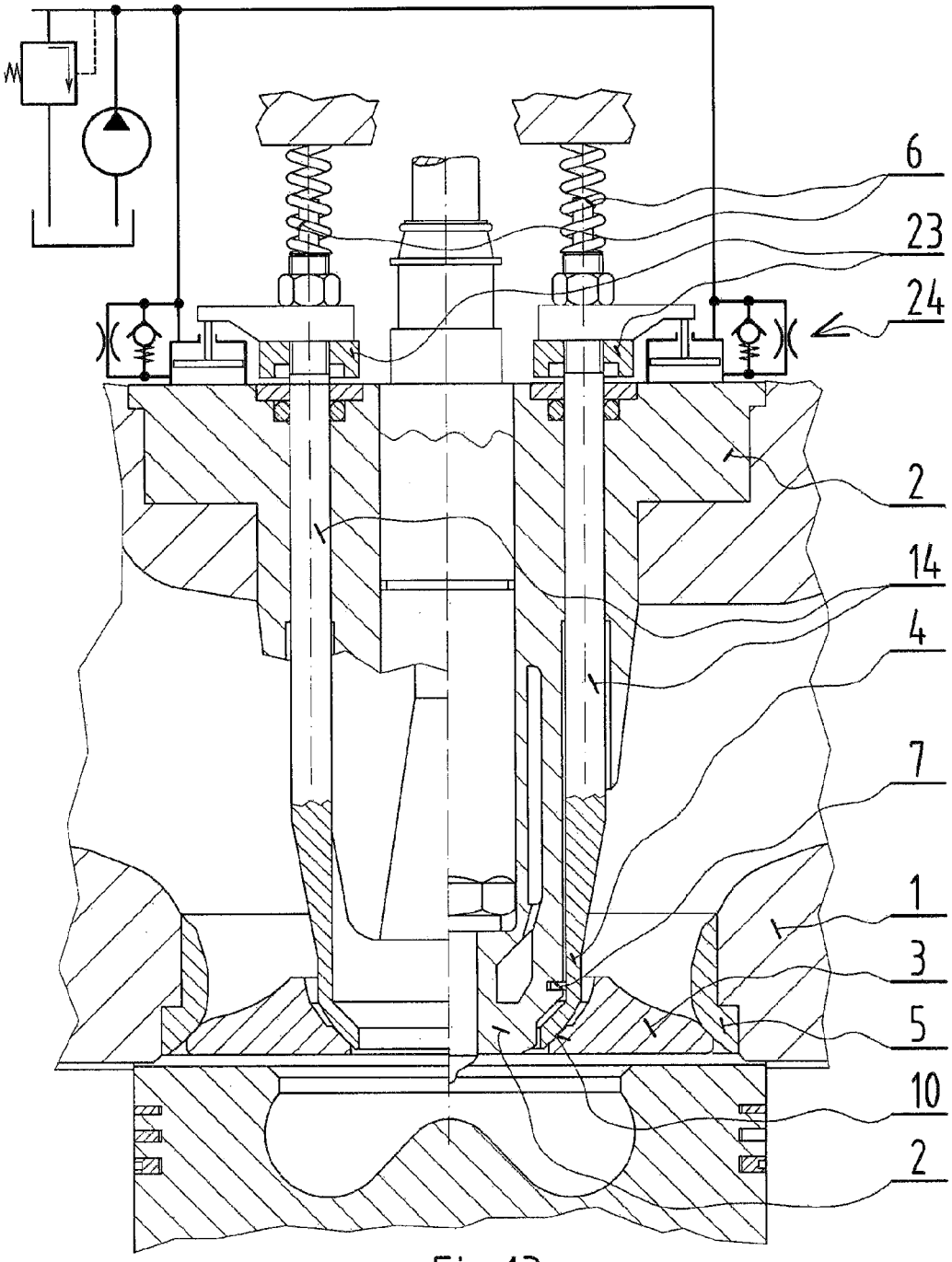
FIG. 13 is a sectional view of the cylinder head with the ring-shaped valve and the inner and outer valve seats. The outer valve seat is fixed in the cylinder head and the inner valve seat is axially slidable. It is sealed against the center of the cylinder head by the seal ring. The inner valve seat has two stems leading to the top of the cylinder head. On the stems are adjustable stops limiting sliding out of the seat. The stems are acted on by hydraulic movement dampers of the inner valve seat.

In the embodiment of a cylinder head of an internal-combustion engine with the ring-shaped valve 3 according to FIG. 13 the outer valve seat 5 is fixed in the body 1. The axially slidably mounted inner valve seat 4 is sealed by the seal member 7—ring that is set in a groove in the rigid center 2. The inner valve seat 4 is provided with two stems 14 that extend through the rigid center 2. On the ends of stems 14 there are fastened stops 23 limiting axial lifting of the inner valve seat 4. On the ends of stems 14 sit biasing members 6 in the shape of springs and hydraulic dampers 24 are connected to them. The seat face 10 of the inner valve seat 4 is frusto-conical.

The cylinder head of an internal-combustion engine with the ring-shaped valve 3 functions as follows. The ring-shaped valve 3 by closing sits down at first on the axially slidably mounted, usually inner valve seat 4, presses this inner valve seat 4 against the resistance of the biasing member 6 and then sits down into the rigid, usually outer valve seat 5. The seat face 10 of the inner valve seat 4 may be advantageously part-spherical and then is secured perfect tightness of this inner valve seat 4 in the seat face 20 of the ring-shaped valve 3 even in case of modest turning of the inner valve seat 4. This seat face 20 may be conical or part-spherical as well. An increase of pressure in a cylinder of the engine pushes the axial slidably mounted inner valve seat 4 to the ring-shaped valve 3 by the pressure force F. This is caused by suitable shape of the inner valve seat 4, where the diameter D1 of contact with seal member ring 7 is greater than the diameter D2 of contact of the seat faces 10 and 20. Tightness between the center 2 of the head and the axially slidably mounted inner valve seat 4 secures the seal member ring 7 that is advantageously set in a groove in the center 2 of the head. The next step of the cylinder head of an internal-combustion engine causes opening the ring-shaped valve 3. If there is higher pressure in the cylinder before opening than pressure above the ring-shaped valve 3, the axially slidably mounted inner valve seat 4 will be able to be pushed to the ring-shaped valve 3 by pressure force F even during opening of the valve 3 in addition to force of the biasing member 6. It will be thus pulled toward the cylinder until movement of the seat is stopped by the safety member 8. This cyclical motion of the inner seat 4 will remove sediment from the space between the inner valve seat 4 and the center 2 of the head. This requires that the radial clearance between the inner valve seat 4 and the center 2 of the head be sufficient to prevent sticking of the inner valve seat 4. The inner valve seat 4 is after opening valve 3 ready in its extended position. Required overlap T, which is necessary for keeping tightness of the ring-shaped valve 3 while the engine is running, is influenced by wear of the valve gear component. This overlap T is decreased by wear of the seat faces 10 and 20. Wear of the seat faces 11 and 21 is increased and wear of the safety member 8 is increased too. Keeping the overlap T seems to be sustainable. When using a hydraulic cylinder as the biasing member 6 it is possible to absorb movement of the inner valve seat 4 by the throttle 19 in both directions or by the one-way damping 18 in the oil supply. Similar function of a cylinder head with the ring-shaped valve 3 is even present when using the inner valve seat 4 with stems 14 whose ends are provided with biasing members 6 and stops 23 substituting for the safety member 8. The hydraulic damper 24 decreases lift of the inner valve seat 4 and thus its wear too while the engine is running.

Similar function of a head will be obtained even when the axially slidable element is the outer valve seat 5. In the closed position of the ring-shaped valve 3 pressure force F will bias the axially slidable outer valve seat 5 toward the ring-shaped valve 3 only when the diameter D1 of contact with the seal ring 7 is smaller than the diameter D2 of contact of the seat faces 11 and 21.

The biasing member 6 can be a spring of various types. Also it may be a hydraulic or pneumatic cylinder, electromagnet and the like.

The safety member 8 can be a thrust nut 12 or plate 13 fixed in the center 2 of the head. The safety member can be an annulus 17 or it can be generally formed by stops from bolts, pins and the like.

For assembling and adjustment of the inner valve seat 4 it is advantageous when the center 2 of the head can be disassembled. For assembling of the ring-shaped valve 3 it is advantageous when the valve guides 26 are fitted with radial clearance. Their position can be secured according to the position of the ring-shaped valve 3 and its stems 25.

INDUSTRIAL APPLICABILITY

A head of an internal-combustion engine with the ring-shaped valve according to this invention will find use in various types of internal-combustion engines for controlling intake, exhaust or common function of intake and exhaust. Use is advantageous for example for exhaust of a two-stroke engine or of a four-stroke engine common for both exhaust and intake.

The invention claimed is:

1. A cylinder head for an internal combustion engine, the cylinder head comprising:
   - a body;
   - a rigid center spacedly surrounded by the body;
   - an annular outer valve seat on the body;
   - an annular inner valve seat on the center;
   - a ring-shaped valve with an outer seat face and an inner seat face and displaceable along an axis into a closed position bearing on the outer valve seat with the outer seat face and on the inner valve seat with the inner seat face, the inner valve seat or outer valve seat being slidable axially;
   - a seal member set in a groove in the center or in the body and engaging the one slidable seat; and
   - at least one biasing member connected to the one slidable valve seat and urging same toward the ring-shaped valve.

2. The cylinder head according to claim 1, wherein the seal member is a seal ring engaging the inner valve seat, a diameter of contact of the seal member with the inner valve seat being greater than a diameter of a seat face of this inner valve seat engaging the ring-shaped valve.

3. The cylinder head according to claim 1, wherein the seal member is a seal ring on the slidably movable outer valve seat, a diameter of contact of the seal ring with the outer valve seat being smaller than a diameter of a seat ing face of this outer valve seat engaging the ring-shaped valve.

4. The cylinder head according to claim 1, wherein the one slidable valve seat is provided with a safety member limiting movement away from the ring-shaped valve.

5. The cylinder head according to claim 1, wherein the one slidable valve seat is provided with at least two stems extending through the center or through the body and provided with adjustable stops or dampers on their ends.

6. The cylinder head according to claim 1, wherein a seat ing face of the one slidable valve seat is part-spherical.

7. The cylinder head according to claim 1, wherein the biasing member is provided with a hydraulic spring with a throttle in an oil supply or one-way throttling in an oil supply.

8. The cylinder head according to claim 1, wherein the center is demountable from the body or valve guides for guiding the valve stems of ring-shaped valve are fitted with radial clearance in the center or in the body of combustion engine cylinder head.

* * * * *